US009062508B2

(12) United States Patent
Huval et al.

(10) Patent No.: US 9,062,508 B2
(45) Date of Patent: Jun. 23, 2015

(54) APPARATUS AND METHOD FOR MILLING/DRILLING WINDOWS AND LATERAL WELLBORES WITHOUT LOCKING USING UNLOCKED FLUID-MOTOR

(71) Applicants: Sidney D. Huval, The Woodlands, TX (US); Michael J. Blackman, Houston, TX (US); Justin P. Butler, Tomball, TX (US)

(72) Inventors: Sidney D. Huval, The Woodlands, TX (US); Michael J. Blackman, Houston, TX (US); Justin P. Butler, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 302 days.

(21) Appl. No.: 13/678,249

(22) Filed: Nov. 15, 2012

(65) Prior Publication Data

US 2014/0131036 A1 May 15, 2014

(51) Int. Cl.

| | |
|---|---|
| ***E21B 7/06*** | (2006.01) |
| ***E21B 23/00*** | (2006.01) |
| ***E21B 29/06*** | (2006.01) |
| ***E21B 47/09*** | (2012.01) |
| ***E21B 47/12*** | (2012.01) |

(52) U.S. Cl.

CPC ..... *E21B 29/06* (2013.01); *E21B 7/061* (2013.01); *E21B 47/09* (2013.01); *E21B 47/122* (2013.01)

(58) Field of Classification Search

CPC ..... E21B 7/06; E21B 29/06; E21B 23/002; E21B 47/024

USPC ..... 166/117.5, 117.6, 255.2, 255.3, 212, 166/63; 175/61, 77, 79, 80, 81, 82, 230

See application file for complete search history.

(56) References Cited

U.S. PATENT DOCUMENTS

| | | | | | |
|---|---|---|---|---|---|
| 4,304,299 | A | * | 12/1981 | Holland et al. | 166/255.3 |
| 4,397,355 | A | * | 8/1983 | McLamore | 166/297 |
| 5,474,126 | A | * | 12/1995 | Lynde et al. | 166/117.6 |
| 5,551,509 | A | * | 9/1996 | Braddick | 166/55.7 |
| 5,740,864 | A | * | 4/1998 | de Hoedt et al. | 166/387 |
| 5,771,972 | A | * | 6/1998 | Dewey et al. | 166/298 |
| 5,816,324 | A | * | 10/1998 | Swearingen et al. | 166/117.5 |
| 5,947,201 | A | * | 9/1999 | Ross et al. | 166/298 |
| 6,454,007 | B1 | | 9/2002 | Bailey | |
| 6,755,248 | B2 | | 6/2004 | Toulouse et al. | |
| 7,000,692 | B2 | * | 2/2006 | Hosie et al. | 166/66 |
| 7,481,282 | B2 | * | 1/2009 | Horst et al. | 175/61 |
| 8,245,774 | B2 | * | 8/2012 | Carter et al. | 166/117.5 |
| 8,739,900 | B2 | * | 6/2014 | Gregurek et al. | 175/79 |
| 8,844,620 | B2 | * | 9/2014 | Gregurek et al. | 166/117.5 |
| 8,991,489 | B2 | * | 3/2015 | Redlinger et al. | 166/242.6 |
| 2002/0060096 | A1 | * | 5/2002 | Brunnert et al. | 175/81 |
| 2014/0209383 | A1 | * | 7/2014 | Vuyk, Jr. | 175/27 |
| 2015/0027708 | A1 | * | 1/2015 | Honekamp | 166/298 |

* cited by examiner

*Primary Examiner* — Kenneth L Thompson
(74) *Attorney, Agent, or Firm* — Cantor Colburn LLP

(57) ABSTRACT

In one aspect, a method of performing a downhole operation is disclosed that in one embodiment may include running a downhole tool including an anchor, a whipstock, a cutting device, and an unlocked fluid-operated motor into a wellbore; wirelessly transmitting signals relating to orientation of the downhole tool from a sensor associated with the downhole tool; orienting the whipstock in response to the transmitted signals and without flowing a fluid through the cutting device; setting the anchor in the wellbore without flowing the fluid through the cutting device; and performing the downhole operation using the motor.

18 Claims, 2 Drawing Sheets

APPARATUS AND METHOD FOR MILLING/DRILLING WINDOWS AND LATERAL WELLBORES WITHOUT LOCKING USING UNLOCKED FLUID-MOTOR

BACKGROUND OF THE DISCLOSURE

1. Field of the Disclosure

The present disclosure relates generally to cutting windows in casings and forming lateral wellbores from a main wellbore using a mud motor-driven cutting device.

2. Description of the Related Art

Many operations in wellbores for recovery of hydrocarbons (oil and gas) include milling a portion of a casing in the wellbore or forming a lateral wellbore from a main cased or open wellbore. Windows are milled or the side wells are formed from specified locations in the main wellbore. To perform such a cutting operation during a single trip, a downhole tool is conveyed in the wellbore that includes a whipstock connected to a cutting device. The cutting tool is operated by a fluid-driven motor, such as a progressive cavity motor. The motor is typically mechanically locked to prevent it from rotating the cutting tool as that will cause the whipstock to rotate. Once the whipstock has been oriented, an anchor attached below the whipstock is hydraulically set by flowing fluid through the locked motor and without breaking the lock on the motor. After the anchor and whipstock have been set, the cutting device is mechanically disengaged from the whipstock and the motor lock is hydraulically broken by rotating the motor. The cutting device is then lowered along the whipstock to perform a milling operation.

The disclosure herein provides apparatus and method for performing milling/cutting operations downhole without locking the motor or flowing fluid through the motor to set the anchor.

SUMMARY

In one aspect, a method of performing a downhole operation is disclosed that in one embodiment may include: conveying a downhole tool in the wellbore that includes an anchor, a whipstock below the anchor, a cutting device, and an unlocked fluid-operated motor that rotates the cutting device the into a wellbore; wirelessly transmitting signals relating to orientation of the downhole tool from a sensor associated with the downhole tool; orienting the whipstock in response to the transmitted signals, setting the anchor without flowing fluid through the motor; disengaging the cutting device from the downhole tool; and performing the downhole operation by operating the cutting device by the motor.

In another aspect, an apparatus for performing a downhole operation is disclosed that in one embodiment may include a cutting device, a fluid-operated motor that rotates the cutting device, a whipstock connected to motor, wherein the motor is free to rotate, a sensor configured to provide measurements relating to orientation of the tool in a wellbore, a telemetry device configured to wirelessly transmit signals relating to the orientation measurements to a surface location and a hydraulically-operated anchor downhole of the whipstock.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DISCLOSURE

Figure 1:
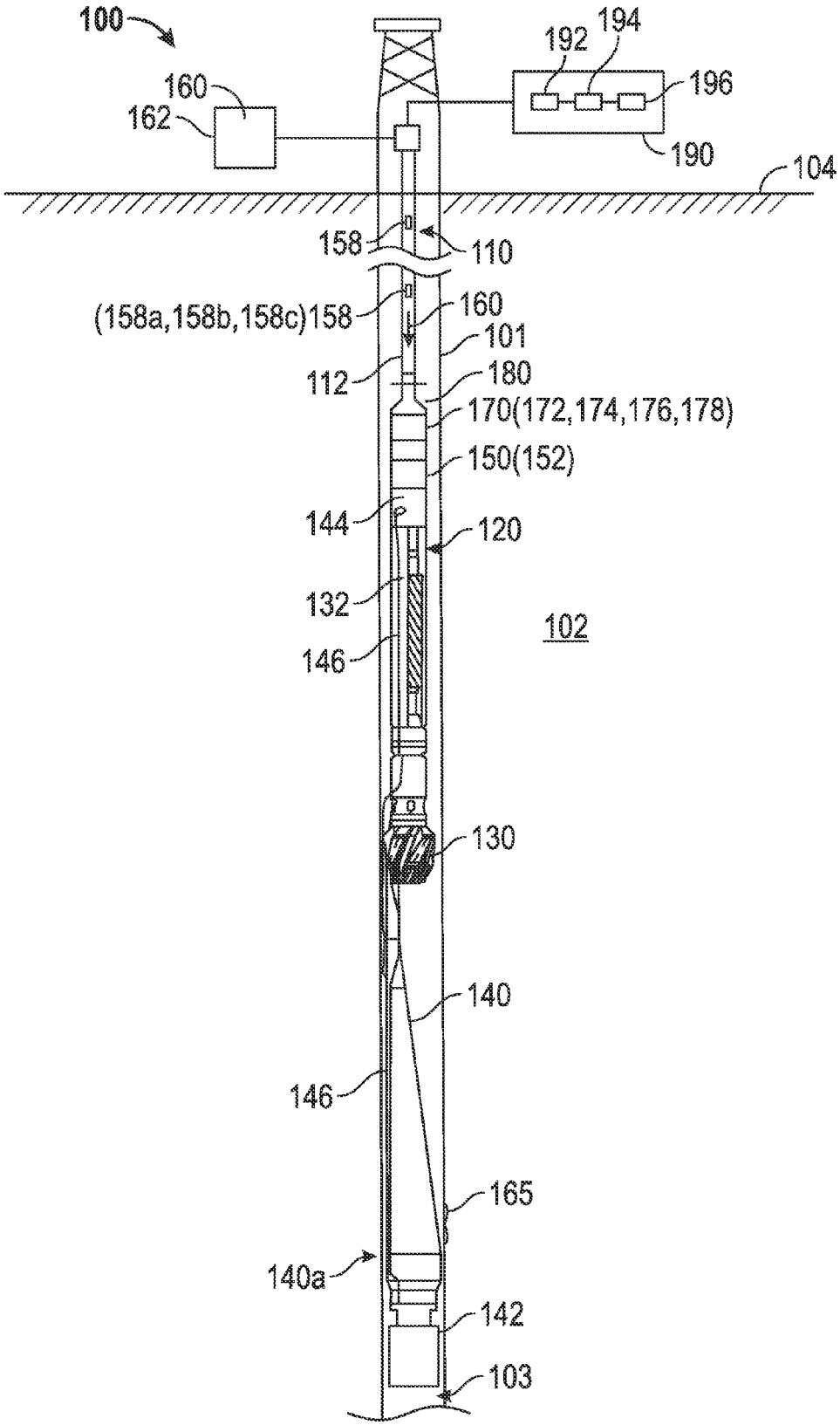
FIG. 1 is a schematic diagram of an exemplary drilling system with a downhole tool conveyed in a wellbore, wherein the downhole tool includes a whipstock, an anchor, a cutting device and an unlocked motor for operating a cutting device, according to one embodiment of the disclosure.

FIG. 1 is a schematic diagram of an exemplary system 100 for performing a milling/cutting operation in a wellbore 101 formed in a formation 102. A drill string 110 is shown conveyed in the wellbore 101 to a desired depth 103. In aspects, the drill string 110 includes a downhole assembly or tool 120 conveyed in the wellbore by a conveying member or tubular 112, such as a coiled tubing or another tubular. The downhole tool 120 includes a cutting device, such as a mill or a drill bit 130 connected to a fluid-operated motor, such as a progressive cavity motor 132. The motor 132 rotates the bit 130 when fluid 160 under pressure is pumped from storage unit 161 at the surface location 104 into the tubular 112. The fluid 160 rotates the motor 132 that, in turn, rotates the bit 130. The downhole tool 120 further includes a detachable whipstock 140 connected to the bit 130 or at another suitable location above (uphole) the bit 130. An anchor 142 is connected below the whipstock 140. In aspects, the anchor 142 may be a hydraulically set packer or another suitable device. A hydraulic control sub 144 supplies a fluid under pressure to the hydraulically-operated anchor 142 via fluid control line 146 to set the anchor 142, as described in more detail in reference to FIG. 2. The hydraulic control line, in one aspect, bypasses the motor 132.

Still referring to FIG. 1, the downhole tool 120 further includes an orientation device 150 that may include one or more magnetometers and accelerometers and other suitable sensors (collectively referred to as orientation sensors and designated by numeral 152). The orientation sensors 152 provide measurements relating to the orientation (such as the tool face) of the downhole tool 120 and thus the orientation of the whipstock 140 that is securely attached to the tool 120. A downhole controller 170 processes the signals from the sensors 152 in the orientation device 150 and transmits the processed signals to a surface controller 190 via a wireless telemetry unit 180. In one embodiment, the downhole controller 170 includes an electric circuit 172 that preprocesses (for example, amplifies) signals from sensors 152, a processor 174, such as microprocessor, that further processes signals from circuit 172 and transmits the processed signals to the surface controller 190 via the wireless telemetry unit 180. The controller 170 may further include a memory device 176, such as a solid state memory, that stores data and programmed instruction 178 accessible to the processor for processing the signals and performing one or more downhole operations. Similarly, the surface controller 190 may include a circuit 192 that receives and conditions signals transmitted by the device 180, a processor 194, a memory device 196 and programmed instructions 198. In one embodiment, the telemetry unit 180, in one embodiment, may include an acoustic transmitter, such as a piezoelectric transmitter or a bender-bar acoustic transmitter. In another aspect, the wireless telemetry unit 180 may include an electromagnetic wave transmitter that induces electromagnetic waves along an outside of the tubular 112.

In operation, in one embodiment sensors 152 send measurement signals to the controller 170, which processes the sensor signals and sends the processed signals to the surface controller 190 via the telemetry device 180. The surface controller 190 determines the orientation of the downhole tool 120 from the received signals. One or more repeaters 158 may be provided along the drill string. The number and spacing of the repeaters 158 depend upon the wellbore depth and the attenuation of the transmitted signals. Each repeater 158 may include a receiver 158*a* that receives the transmitted wireless signals, an amplifier 158*b* that amplifies such received signals and a transmitter 158*c* that transmits the amplified signals. A common transceiver may be used both as the transmitter and the receiver in each repeater. The repeater components may be powered by battery pack.

To mill a window or drill a side hole in the wellbore 101 at location 165, the downhole tool 120 is conveyed into the wellbore 101 to the depth 103 so that the lower end 140*a* of the whipstock 140 is so positioned that the bit 130 will cut the hole at the location 165. The controller 170 processes the signals from the orientation sensors 152 and sends the processed signals to the surface controller 190 via the wireless telemetry device 180 and the repeaters 158, if used. The surface controller 190 determines the orientation of the downhole tool 120 and thus the orientation of the whipstock 140 because the whipstock location relative to a location on the tool 120 is known. The whipstock 140 is oriented along a desired direction based on the determined orientation of the tool 120 determined by the controller 190. In one aspect, the whipstock may be oriented by applying rig hand rotation of the drill pipe. The right hand rotation at the surface is transmitted downhole and the orientation device reads the change in position relative to the wellbore thus determining the orientation of the whipstock face. In a coiled tubing application the orientation of the whipstock through surface manipulations cannot be done due to the inability of coiled tubing to rotate. In such a case, the orientation of the whipstock face can be a fixed orientation relative to the wellbore. The orientation of the whipstock may be monitored and confirmed by continually processing the orientation sensor 152 signals. In aspects, the downhole controller 170 and/or the surface controller 190 may be programmed to determine the whipstock orientation before, during and after setting the anchor 142. The hydraulic sub 144 is then activated to set the anchor 142 in the wellbore 101, without flowing fluid 160 through the motor 132. After setting the anchor 142, the whipstock 140 is disengaged from the bit 130 by pulling or pushing the bit 130 and breaking the mechanical connection between the whipstock and the rest of the downhole tool 120. The drilling assembly 120 is then moved downhole along the whipstock 140 to contact the wellbore at location 165. The bit 130 is then rotated by flowing fluid 160 under pressure through the motor 132 to perform a cutting operation downhole during a single trip of the downhole tool 120 in the wellbore 101.

In the downhole tool 120 embodiment shown in FIG. 1, the motor 132 remains unlocked during the entire downhole operation, i.e., it remains free to rotate. In other aspects, the tool 120 orientation information is transmitted to the surface via the wireless telemetry device 180 via the tool conveying member 112. The whipstock 140 is oriented based on the determined orientation of the tool 120, without flowing fluid 160 through the motor 132. The anchor 140 also can be set in the wellbore 101 without flowing the fluid 160 through the motor.

Figure 2:
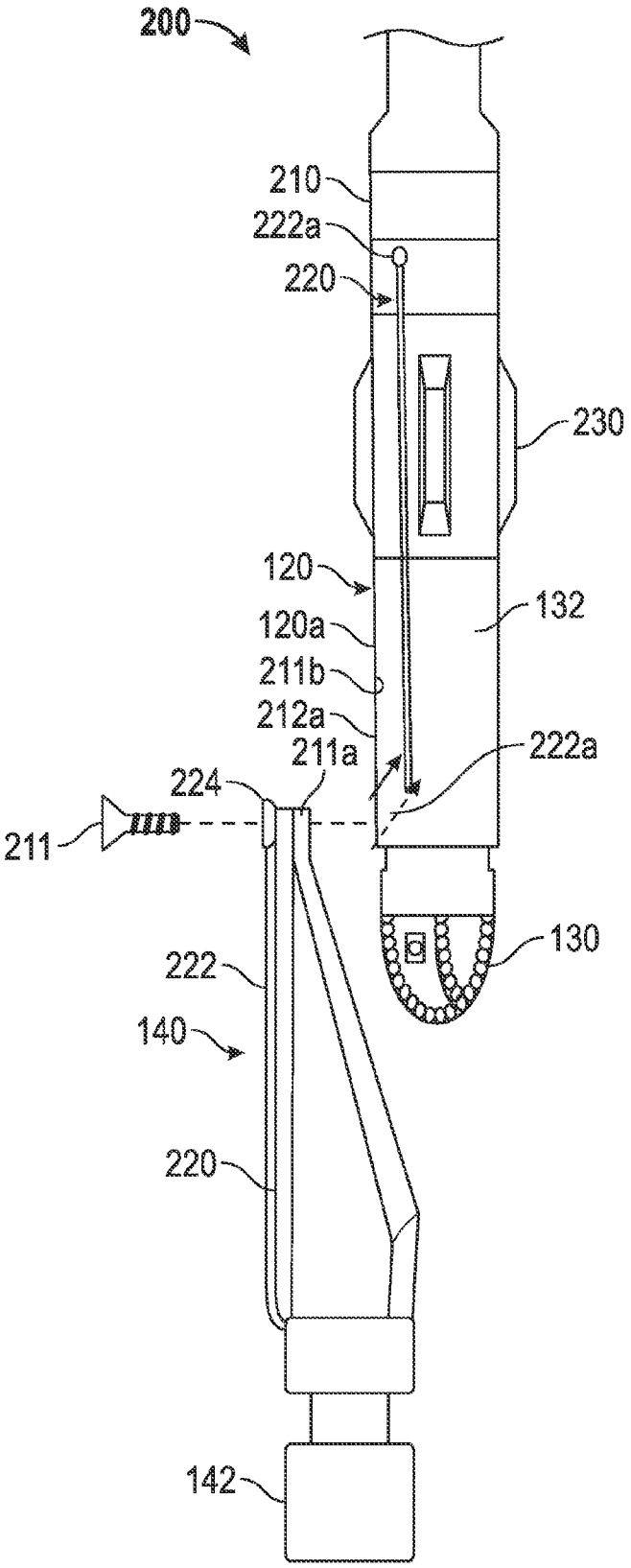
FIG. 2 shows a schematic diagram of a device for hydraulically setting the anchor without flowing fluid through the motor, according to one embodiment of the disclosure.

FIG. 2 shows an exemplary manner of connecting the whipstock 140 to a location on the tool 120 and a hydraulic setting device 220 for setting the anchor 142, without flowing fluid 160 through the motor 132. In one embodiment, the whipstock 140 may be connected to the bit 130 by an attachment lug 211 at a location 211*a* proximate to or on the bit 130. Alternatively, the whipstock 140 may be connected to any other location on the tool 120, including a location 211*b* on the body 120*a* of the tool 120. The lug 211 firmly holds the whipstock 140 on the selected location 211*a*, 211*b*, such as locations. The tool 120 also includes a hydraulic setting device 220. The hydraulic setting device 220 includes a fluid line 222 that runs from a location 222*a* above (uphole) the motor 132 to the anchor 142, bypassing the motor 132. The fluid line 222 may be routed from the body 132*a* of the motor via a connection line 224. Such a bypass allows the fluid to flow to the anchor 142 without flowing it through the motor 132. Alternatively, the fluid line 222 may be run through the bit. In one aspect, the fluid line 222 is a flexible tubing or hose. One or more stabilizers 230 may be provided to reduce lateral vibration of the tool 120 in the wellbore.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A method of performing an operation in a wellbore, comprising:

conveying a downhole tool that includes an anchor, a whipstock, a cutting device, and an unlocked fluid-operated motor configured to operate the cutting device into a wellbore;

wirelessly transmitting signals relating to orientation of the downhole tool from a sensor associated with the downhole tool;

determining orientation of the whipstock in response to the transmitted signals;

orienting the whipstock to a desired orientation based on the determined orientation, without flowing a fluid through the cutting device;

setting the anchor in the wellbore without flowing the fluid through the motor; and performing the operation using the cutting device by flowing the fluid through the motor.

2. The method of claim 1 further comprising orienting the whipstock and setting the anchor without locking the motor.

3. The method of claim 1, wherein transmitting wireless signals comprises sending signals selected from a group consisting of: acoustic signals; and electromagnetic signals along a member conveying the downhole tool into the wellbore.

4. The method of claim 3 further comprising providing a repeater in the wellbore that receives the transmitted signals, conditions the received signals and retransmits the conditioned signals to the surface.

5. The method of claim 1, wherein setting the anchor comprises hydraulically setting the anchor using the fluid line that bypasses the motor.

6. The method of claim 1 further comprising disengaging the whipstock from the motor after setting the anchor and before performing the operation.

7. The method of claim 1, wherein the downhole operation is selected from a group consisting of: (i) cutting a window in a casing in the wellbore; and (ii) forming a lateral wellbore from the wellbore.

8. The method of claim 1, wherein orienting the whipstock is performed by rotating the downhole tool in the wellbore.

9. The method of claim 1, wherein the sensor includes a plurality of accelerometers and gyroscopes.

10. A method for performing a downhole operation in a wellbore, comprising:

conveying a drill string having a downhole tool that includes a device configured to provide signals relating to orientation of the downhole tool in the wellbore, a transducer configured to wirelessly transmit the signals to a surface location, a cutting device, an unlocked fluid-operated motor that is substantially free to rotate the cutting device, a whipstock connected to the downhole tool and an anchor;

transmitting the signals wirelessly to the surface location;

determining orientation of the downhole tool using the transmitted signals;

orienting the whipstock based at least in part on the determined orientation without flowing a fluid through the motor;

setting the anchor hydraulically without flowing the fluid through the motor;

disengaging the whipstock from the downhole tool; and performing the downhole operation using the motor.

11. A downhole tool for performing a downhole operation, comprising:

a cutting device;

an unlocked fluid-operated motor that is free to rotate the cutting device when a fluid is passed through the motor;

a whipstock connected to a selected location in the downhole tool;

a sensor that provides measurements relating to orientation of the downhole tool in a wellbore;

a wireless telemetry device that transmits signals corresponding to the measurement signals to a surface location; and a hydraulically-operated anchor downhole of the whipstock, wherein the whipstock is oriented and the anchor is set without flowing the fluid through the motor.

12. The apparatus of claim 11, wherein the anchor is configured to be set and the whipstock is configured to be oriented while the motor is free to rotate.

13. The apparatus of claim 11, wherein the sensor includes a magnetometer and an accelerometer.

14. The apparatus of claim 11, wherein the wireless telemetry device includes a transmitter that transmits signals selected from a group consisting of: acoustic signals; and electromagnetic signals.

15. The apparatus of claim 14 further comprising a repeater that receives the transmitted signals, amplifies the received signals, and transmits the amplified signals to the surface location.

16. The apparatus of claim 11 further comprising a hydraulic device for setting the anchor that includes a hydraulic line from the hydraulic device to the anchor that bypasses the cutting device and the motor.

17. The apparatus of claim 11 further comprising a controller at the surface location that determines the orientation of the downhole tool using the signals sent to the surface location.

18. The apparatus of claim 11 further comprising a tubular that conveys the downhole tool in the wellbore, and wherein rotating the tubular rotates the downhole tool for orienting the downhole tool along a selected direction.

* * * * *